US005601466A

United States Patent [19]

Shen et al.

[11] Patent Number: 5,601,466

[45] Date of Patent: Feb. 11, 1997

[54] METHOD FOR FABRICATING FIELD EMISSION DEVICE METALLIZATION

[75] Inventors: Chi-Cheong Shen, Richardson; Lester L. Hodson, McKinney, both of Tex.

[73] Assignee: Texas Instruments Incorporated, Dallas, Tex.

[21] Appl. No.: 424,833

[22] Filed: Apr. 19, 1995

[51] Int. Cl.[6] ..... H01J 9/02

[52] U.S. Cl. ..... 445/24

[58] Field of Search ..... 445/24, 50; 313/309

[56] References Cited

U.S. PATENT DOCUMENTS

| | | | |
|---|---|---|---|
| 3,755,704 | 8/1973 | Spindt et al. | 313/309 |
| 4,850,919 | 7/1989 | DiSanto et al. | 445/24 |
| 4,857,161 | 8/1989 | Borel et al. | 204/192.26 |
| 4,857,799 | 8/1989 | Spindt et al. | 313/495 |
| 4,940,916 | 7/1990 | Borel et al. | 313/306 |
| 5,153,754 | 10/1992 | Whetten | 257/59 |
| 5,194,780 | 3/1993 | Meyer | 315/169.3 |
| 5,200,360 | 4/1993 | Bradbury et al. | 437/192 |
| 5,225,820 | 7/1993 | Clerc | 340/752 |
| 5,312,514 | 5/1994 | Kumar | 445/51 |
| 5,507,676 | 4/1996 | Taylor et al. | 445/50 |

*Primary Examiner*—Kenneth J. Ramsey
*Attorney, Agent, or Firm*—Rose Alyssa Keagy; Richard L. Donaldson

[57] ABSTRACT

Methods of fabricating an emitter plate 10 having titanium tungsten (Ti:W) and aluminum (Al) used in a sublayering arrangement as the metallization material for the gate electrodes 60, cathode electrodes 20, bond pads 80 and 130, lead interconnects 100, 101, 120 and 121, and integrated circuit (IC) mount pads 90 and 91. In a disclosed embodiment, titanium tungsten and aluminum sublayers are combined with niobium to provide the metallization material.

13 Claims, 3 Drawing Sheets

100
90
20
30
20

100
90
20
40
30
20

110
110
100
90
20
40
70
30
20

120
110
110
100
90
80
20
60
40
70
30
20

METHOD FOR FABRICATING FIELD EMISSION DEVICE METALLIZATION

RELATED APPLICATION

This application includes subject matter which is related to U.S. patent application Ser. No. 08/424,915, "Field Emission Device Metallization Including Titanium Tungsten and Aluminum," (Texas Instruments, Docket No. TI-18503), filed Apr. 19, 1995.

TECHNICAL FIELD OF THE INVENTION

The present invention relates generally to method for fabricating field emission flat panel display devices and, more particularly, to a method for fabricating matrix-addressable field emission devices having metallization layers of titanium tungsten and aluminum forming one or more of the gate and cathode electrodes, the integrated circuit mount pads and the lead interconnects.

BACKGROUND OF THE INVENTION

For more than half a century, the cathode ray tube (CRT) has been the principal electronic device for displaying visual information. The widespread usage of the CRT may be ascribed to the remarkable quality of its display characteristics in the realms of color, brightness, contrast and resolution. One major feature of the CRT permitting these qualities to be realized is the use of a luminescent phosphor coating on a transparent faceplate.

Conventional CRT's, however, have the disadvantage that they require significant physical depth, i.e., space behind the actual display surface, making them bulky and cumbersome. They are fragile and, due in part to their large vacuum volume, can be dangerous if broken. Furthermore, these devices consume significant amounts of power.

The advent of portable computers has created intense demand for displays which are light-weight, compact and power efficient. Since the space available for the display function of these devices precludes the use of a conventional CRT, there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color screens tend to be far more costly than CRT's of equal screen size.

As a result of the drawbacks of liquid crystal display technology, thin film field emission display technology has been receiving increasing attention by industry. Flat panel displays utilizing such technology employ a matrix-addressable array of pointed, thin-film microtips providing field emission of electrons in combination with an anode comprising a phosphor-luminescent screen.

The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,857,161, "Process for the Production of a Display Means by Cathodoluminescence Excited by Field Emission," issued 15 Aug. 1989, to M. Borel et al.; U.S. Pat. No. 4,857,799, "Matrix-Addressed Flat Panel Display," issued 15 Aug. 1989, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to M. Borel et al.; U.S. Pat. No. 5,194,780, "Electron Source with Microtip Emissive Cathodes," issued 16 Mar. 1993 to R. Meyer; and U.S. Pat. No. 5,225,820, "Microtip Trichromatic Fluorescent Screen," issued 6 Jul. 1993, to J.-F. Clerc. These patents are incorporated by reference into the present application.

The Spindt et al. ('799) patent discloses a field emission flat panel display having a glass substrate on which are arranged a matrix of conductors. In one direction of the matrix, conductive columns comprising the cathode electrodes support the microtips. In the other direction, above the column conductors, perforated conductive rows comprise the gate electrodes. The row and column conductors are separated by an insulating layer having holes permitting the passage of the microtips, each intersection of a row and column corresponding to a pixel.

The prior art references teach the use of various materials as the conductors comprising the cathode and gate electrodes. Among the materials suggested as the cathode conductor are indium oxide, tin dioxide, aluminum, antimony-doped or fluorine-doped tin oxide, tin-doped indium oxide (ITO), and niobium, citing their properties of good electrical conductivity and good adhesion to the substrate and the insulating layer. For the gate conductor, the prior art references recommend niobium, tantalum, aluminum, molybdenum, chromium, antimony-doped or fluorine-doped tin oxide, and ITO, citing their properties of good adhesion to the insulating layer and chemical resistance to the products used to form the microtips. Among these materials, niobium is the conductor most commonly cited for use as the cathode and gate electrodes.

While niobium performs adequately as the electrode material in field emission devices, it does present certain disadvantages. For example, it is not a material which is commonly used in ordinary semiconductor fabrication processes, it is relatively expensive, and, most significantly, it is not a good bonding material for interconnects or integrated circuits. It is therefore desirable to provide a material for use in a field emission device as the metallization layers which form the gate and cathode electrodes, the integrated circuit (IC) mount pads and the lead interconnects, which material is cheaper than niobium, is more commonly used in the semiconductor industry, and provides improved bonding over niobium to IC's and interconnects.

SUMMARY OF THE INVENTION

In accordance with the principles of the present invention, there is disclosed herein a method of fabricating an electron emission apparatus. The method comprises the steps of forming a conductor on an insulating substrate; forming an insulating layer over the conductor; forming a conductive layer on the insulating layer; forming a plurality of apertures through the conductive layer and through the insulating layer; and forming a microtip emitter within each of the apertures, wherein at least one of the conductor and the conductive layer comprises sublayers of titanium tungsten (Ti:W) and aluminum (Al). Alternatively, other adhesive and conductive metals may be used for the conductor and the conductive layer. For example, instead of titanium tungsten either titanium nitride (TIN) or just titanium (Ti) may be used. Instead of aluminum either tungsten (W), gold (Au), silver (Ag), or platinum (Pt) may be used.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
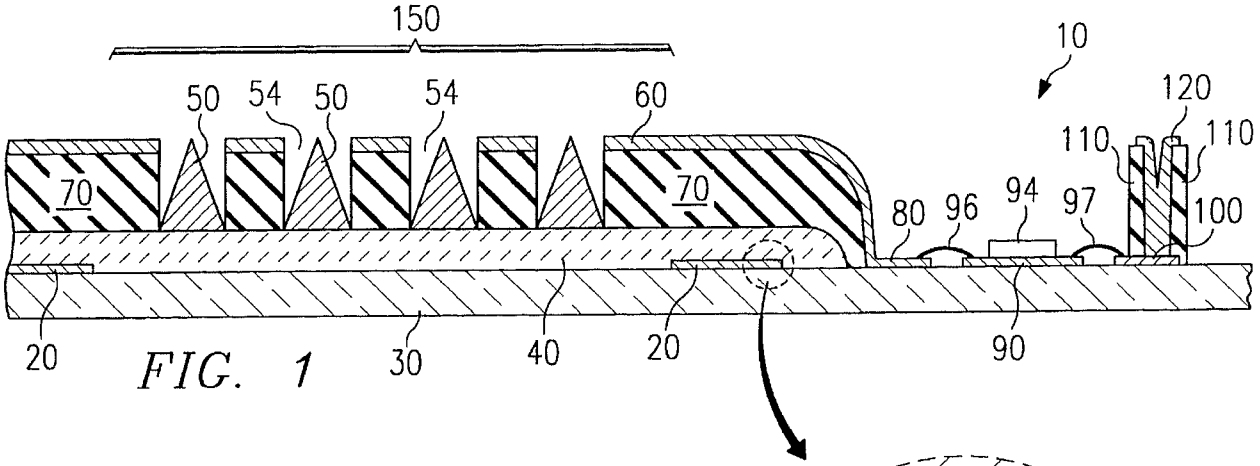
FIG. 1 illustrates in cross section a portion an emitter plate of a field emission flat panel display device in accordance with a preferred embodiment of the present invention.

Referring initially to FIG. 1, there is shown, in cross-sectional view, a portion of an emitter plate 10 for use in a field emission flat panel display device in accordance with the present invention. The cathode electrode of emitter plate 10 includes column conductors 20 formed on an insulating substrate 30, a resistive layer 40 also formed on substrate 30 and overlaying conductors 20, and a multiplicity of electrically conductive microtips 50 formed on resistive layer 40. In accordance with the teachings of the Meyer ('780) patent, conductors 20 may comprise a mesh structure, wherein microtip emitters 50 are configured as an array 150 within the spacings of the mesh structure.

The gate electrode of emitter plate 10 comprises a layer 60 of an electrically conductive material which is deposited on an insulating layer 70 which overlays resistive layer 40. Microtip emitters 50 are in the shape of cones which are formed within apertures through conductive layer 60 and insulating layer 70. The thicknesses of gate electrode layer 60 and insulating layer 70 are chosen in such a way that the apex of each microtip 50 is substantially level with the electrically conductive gate electrode layer 60. Conductive layer 60 is arranged as rows of conductive bands across the surface of substrate 30, and the mesh structure of conductors 20 is arranged as columns of conductive bands across the surface of substrate 30 substantially orthogonal to the conductive bands of gate electrode layer 60, thereby permitting matrix-addressed selection of microtips 50 at the intersection of a row and column corresponding to a pixel. An edge of conductive layer 60 forms a gate bonding pad 80 for accepting bond wires to thereby facilitate electrical connection with external circuitry.

Emitter plate 10 further comprises conductive layer 90 formed on substrate 30 to provide a mount pad for IC 94. Conductive layer 100, overlaid by insulating layer 110, and further overlaid by another conductive layer 120, forms lead interconnects for the cathode and gate conductors.

Figure 1A:
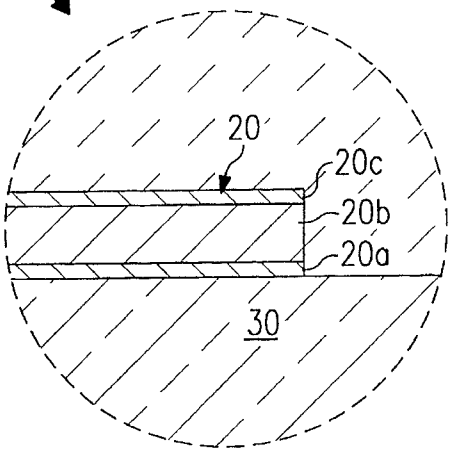
FIG. 1A provides a detailed view of the cross section of a metallization layer of the emitter plate of FIG. 1.

FIG. 1A provides a detailed view of the cross section of column conductor 20 of the emitter plate 10 of FIG. 1, depicting an illustrative sublayer structure in accordance with the present invention. In this example, the metallization forming conductor 20 comprises three sublayers. Sublayer 20*a*, which may comprise titanium tungsten (Ti:W), is selected for its qualities as barrier and adhesion. Sublayer 20*b*, which may comprise aluminum, is selected for its qualities as a conductor. Sublayer 20*c*, which may comprise Ti:W, is selected for its qualities as a barrier. By way of illustration, sublayers 20*a* and 20*c* may be between 150 and 300 nm in thickness, and sublayer 20*b* may be between 600 and 900 nm in thickness. Although FIG. 1A illustrates the sublayering with reference to column conductor 20, it is intended that the metallization structure disclosed herein may be used in forming any one or more of the following: column (cathode) conductors 20, row (gate) conductors 60, mount pad conductors 90 and lead interconnects 100 and 120. Furthermore, it is intended that the scope of this invention also includes the case where conductor 20 comprises only sublayers 20*a* and 20*b*, and the case where conductor 20 comprises only sublayers 20*b* and 20*c*.

Figure 2:
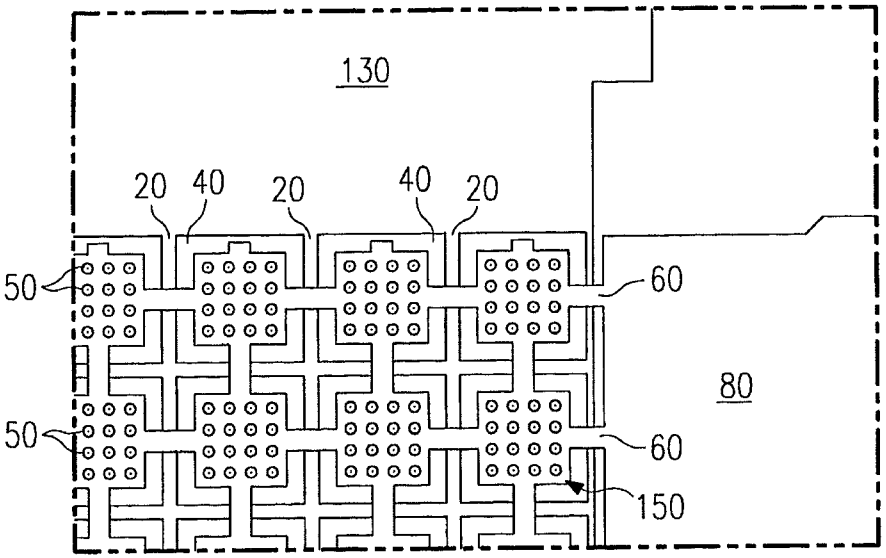
FIG. 2 illustrates in plan view a portion of a field emission flat panel display device emitter plate in accordance with a preferred embodiment of the present invention.

FIG. 2 illustrates a plan view of a portion of a field emission flat panel display device emitter plate 10, which is shown in a somewhat truer scale than the cross-sectional view of FIG. 1. Consistent numbering is used to match regions shown in FIG. 2 to corresponding regions of FIG. 1. FIG. 2 additionally shows bond pad 130 formed at an end of column mesh structure 20 for accepting bond wires to thereby facilitate electrical connection with external circuitry. For ease of comprehension, the view provided by FIG. 2 presumes transparency of resistive layer 40 and insulating layer 70, so that the paths of conductors 20 and 60 are more readily observed.

Figure 3:
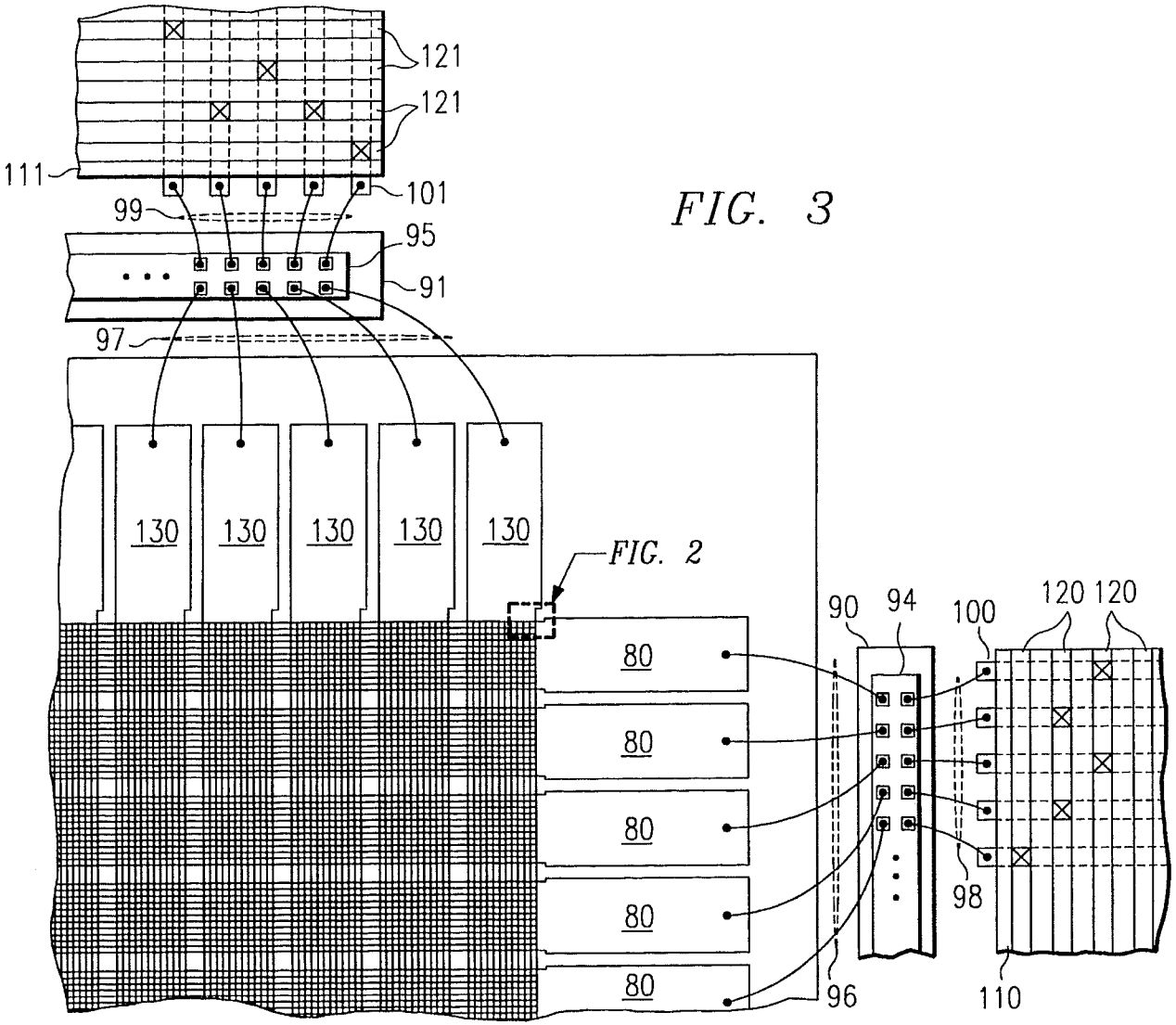
FIG. 3 illustrates a more expansive plan view of a portion of an emitter plate encompassing the portion shown in FIG. 2.

FIG. 3 illustrates a more expansive plan view of a portion of emitter plate 10 encompassing the portion shown in FIG. 2. This view includes IC mount pad 90 and interconnects 100 and 120, associated with the gate bonding pads 80 and their related electronics, and IC mount pad 91 and interconnects 101 and 121, associated with the cathode bonding pads 130 and their related electronics.

At the edge of the emitter structure adjacent gate bonding pads 80, integrated circuit 94, illustratively including driver circuits for gate conductors 60 (FIG. 2), is attached to mount pad 90. Leads 98 couple electrical signals between interconnect conductors 100 to bond pads on IC 94, and leads 96 couple electrical signals between gate conductor bond pads 80 and bond pads on IC 94.

Similarly, at the edge of the emitter structure adjacent cathode bonding pads 130, integrated circuit 95, illustratively including driver circuits for cathode conductors 20 (FIG. 2), is attached to mount pad 91. Leads 99 couple electrical signals between interconnect conductors 101 to bond pads on IC 95, and leads 97 couple electrical signals between cathode conductor bond pads 130 and bond pads on IC 95.

In accordance with the present invention, one or more of the following metallization layers are formed as sublayers of titanium tungsten (Ti:W) and aluminum (Al): row (gate) conductors 60 and 80, column (cathode) conductors 20 and 130, IC mount pads 90 and 91, and row and column lead interconnects 100, 101, 120 and 121. Any or all of these layers may be of the type shown in FIG. 1A and described in the accompanying text.

The use of a Ti:W/Al/Ti:W sublayering structure, instead of the currently used niobium to form conductive layers 20, 60, 80, 90, 91, 100, 101, 120, 121 and 130 has many advantages. First, niobium is not a commonly used material in the semiconductor industry and therefore more effort is required to include niobium in the manufacture of field emission flat panel displays. Another advantage in the use of Ti:W/Al/Ti:W is that it is less expensive than niobium and product costs are reduced. Most significantly, Ti:W/Al/Ti:W provides better bonding than niobium to the currently used aluminum-leaded IC's and interconnect leads.

A method of fabricating an emitter plate for use in a field emission flat panel display device in accordance with a first embodiment incorporating the principles of the present invention, comprises the following steps, considered in relation to FIGS. 4A through 4D. The relationship between the elements of FIGS. 4A through 4D and those elements of FIG. 1, 1 A, and 3 should be apparent from the disclosure of the materials of the various layers. The widths and thicknesses of the various layers are highly exaggerated and distorted, and no true scaling information can be perceived therefrom.

Figures 4A, 4B, 4C, 4D:
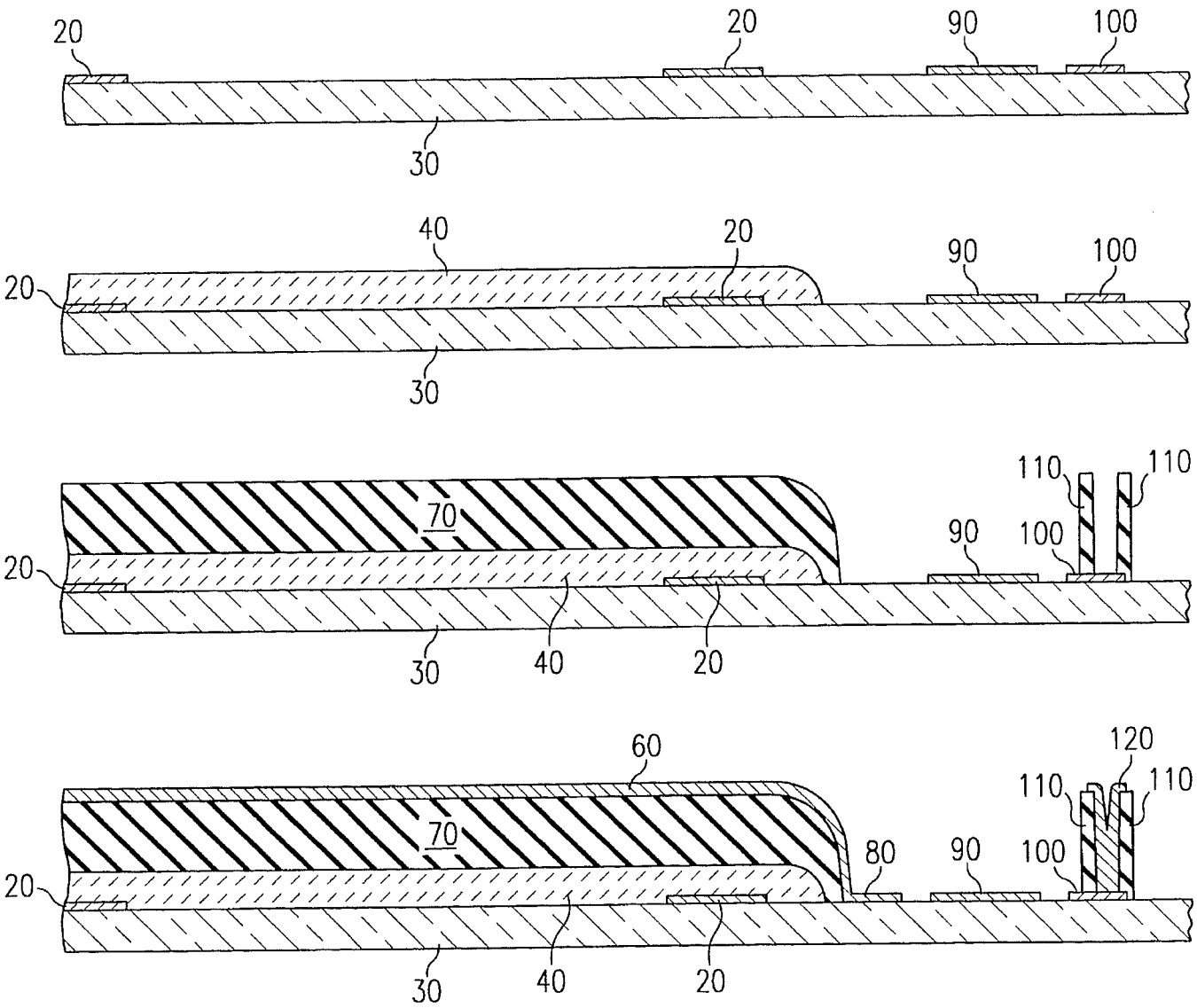
FIGS. 4A through 4D illustrate steps in a process for fabricating the emitter plate of FIG. 1 in accordance with a preferred embodiment of the present invention.

A method for fabricating emitter plate 10, in accordance with the present invention, may comprise the following steps: providing an insulating substrate 30, and depositing a first layer of conductive material on substrate 30 and forming mesh structure 20 and bus regions 130 (not shown), IC mount pads 90 and 91 (not shown), row lead interconnects 100 and column lead interconnects 101 (not shown) therefrom, typically by photolithographic and etching processes, leaving the structure illustrated in FIG. 4A. This is followed by forming a layer 40 of an electrically resistive material over substrate 30 and conductive mesh structure 20 without covering bus regions 130, leaving the structure illustrated in FIG. 4B. This is followed by depositing a coating of electrically insulating material and forming therefrom insulating layer 70 overlaying resistive layer 40 and insulating structures 110 and 111 (not shown), leaving the structure illustrated in FIG. 4C. This is followed by depositing a second layer of conductive material on layer 70 and forming row structure 60 and bus regions 80, and upper-level lead interconnects 120 and 121 (not shown) therefrom, typically by photolithographic and etching processes, leaving the structure illustrated in FIG. 4D. In the above recited process, one or both of the first and second conductive layers comprises sublayers of Ti:W sandwiched around an aluminum sublayer.

The remaining steps of the method are well known in the art, and include forming a plurality of apertures 54 in row structure 60 within the spacings defined by mesh structure 20, the apertures 54 extending through insulating layer 70 down to resistive layer 40; and forming a microtip emitter 50 within each of the apertures 54 in row structure 60.

The above-described method may be more fully understood by reference to the following illustrative process. A glass substrate 30 may be coated with a thin insulating layer (not shown), typically $SiO_2$, which is typically sputter deposited to a thickness of 50 nm.

A first conductive layer, comprising sublayers of titanium tungsten, aluminum and titanium tungsten (Ti:W/Al/Ti:W) are sputtered to a total thickness of approximately 0.4 microns on substrate 30. A layer of photoresist (not shown), illustratively type AZ-1350J sold by Hoescht-Celanese of Somerville, N.J., is spun on over the conductive layer to a thickness of approximately 1000 nm. A patterned mask (not shown) is disposed over the light-sensitive photoresist layer, exposing desired regions of the photoresist to light. The mask used in this step defines the column mesh structure 20, bond pads 130, IC mount pads 90 and 91, and row and column lead interconnects 100 and 101. The unwanted photoresist regions are removed during the developing step, which may comprise soaking the assembly in a caustic or basic chemical such as Hoescht-Celanese AZ-developer. The exposed regions of the conductive layer (Ti:W) are then removed, typically by a reactive ion etch (RIE) process using boron trichloride ($BCl_3$) and chlorine ($Cl_2$) for aluminum and carbon tetrafluoride ($CF_4$) for titanium tungsten, or by a wet chemical etch. The remaining photoresist layer is removed by a wet etch process using acetone or toluene as the etchant, leaving the structure illustrated in FIG. 4A.

A resistive layer 40 is added by sputtering amorphous silicon ($\alpha$-Si) onto substrate 30 to a thickness of approximately 500–2000 nm; alternatively the amorphous silicon may be deposited by a chemical vapor deposition (CVD) process. A layer of photoresist is again applied, a mask defining the active region including cathode mesh structure 20 is disposed over the emitter plate, and the photoresist is developed. The exposed regions of amorphous silicon are removed by a RIE etch process using sulfer hexafluoride ($SF_6$). FIG. 4B illustrates the emitter structure having amorphous silicon layer 40 at the current stage of the fabrication process.

An electrically insulating layer silicon dioxide ($SiO_2$) of approximately 1000 nm is now deposited. Photoresist (not shown) is spun on the oxide layer, a patterned mask (not shown) is disposed over the light-sensitive photoresist, and the photoresist is exposed to light. The photoresist remaining after the developing step defines the gate insulating layer 70, and also gate and column interconnect oxide layers 110 and 111. The exposed regions of the oxide layer are removed, typically by a reactive ion etch process using trifluoromethane ($CHF_3$), leaving the structure illustrated in FIG. 4C.

A second conductive layer, comprising sublayers of titanium tungsten, aluminum and titanium tungsten (Ti:W/Al/Ti:W) are sputtered to a thickness of approximately 0.6 microns over the entire emitter plate 10. A layer of photoresist is spun over the Ti:W/Al/Ti:W layer, a patterned mask defining gate mesh structure 60, gate lead bond pads 80, and double level metal interconnect leads 120 and 121 for the gate and column structures is then disposed over the light-sensitive photoresist layer. Next, the development step removes the unwanted photoresist regions which were exposed to light. The exposed regions of the Ti:W/Al/Ti:W layer are then removed, typically by a reactive ion etch (RIE) process described previously with relation to FIG. 4A. FIG. 4D illustrates the emitter structure at the current stage of the fabrication process.

The processes for etching apertures 54 in conductive layer 60 and insulating layer 70, and for forming microtip emitters 50 within apertures 54, are considered to be well known, and are disclosed, for example, in the Borel et al. ('161) patent. The described process includes a reactive ion etch of conductive layer 60 using a sulfur hexafluoride ($SF_6$) plasma. Apertures 54 are formed in the insulating layer 70 by chemical etching, e.g., by immersing the structure in a hydrofluoric acid and ammonium fluoride etching solution. The microtip emitters 50 are formed by first depositing a nickel coating (not shown) by vacuum evaporation at a glancing angle with respect to the surface of the structure, thus ensuring that the apertures 54 do not become blocked. This is followed by the deposition of a molybdenum coating (not shown) on the complete structure at a normal incidence, thereby forming the cone-shaped emitters 50 within apertures 54. The nickel coating is then selectively dissolved by an electrochemical process so as to expose the perforated conductive layer 60 and bring about the appearance of the electron emitting microtips 50.

In an alternate embodiment of the present invention, the conductive material in the active region of emitter plate 10, defined with reference to FIG. 2 as the area including cathode mesh structure 20 and gate electrodes 60, comprises niobium. The active region is the area encompassing all display pixels. However, in the areas outside the active region where wire bonding or IC mounting occurs, namely 80, 90, 91, 100, 101, 120, 121 and 130, the disclosed sublayering arrangement of Ti:W/Al/Ti:W is sputtered on top of the niobium layer. The relative thicknesses of these conductive regions will be approximately as follows: Nb 200 nm, Ti:W 150 nm, Al 600 nm, Ti:W 150 nm. In accordance with still another embodiment of the present invention, all areas of metallization, namely 20, 60, 80, 90, 91, 100, 101, 120, 121 and 130, are formed by sputtering Nb/Ti:W/Al/Ti:W in the above relative thicknesses.

Several other variations in the above processes, such as would be understood by one skilled in the art to which it pertains, are considered to be within the scope of the present invention. For example, the sublayers 20*a* and 20*c* may comprise alternative metals which promote adhesion, such as titanium (Ti) and titanium nitride (TIN). Furthermore, the sublayer 20*b* may comprise alternative metals which promote conductivity, such as tungsten (W), gold (Au), silver (Ag), and platinum (Pt). According to another variation, the sublayer 20*c* may be removed from areas outside the active region, such as the row and column bond pads 80 and 130, the integrated circuit mount pads 90 and 91, and the first-level and second-level row and column interconnects 100 and 101, and 120 and 121, for the purpose of ensuring a good electrical connection to other structures such as bond wires and device package leads:

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead by gauged by the breadth of the claims which follow.

What is claimed is:

1. A method of fabricating an electron emission apparatus comprising the steps of:

forming a conductive mesh structure on an insulating substrate, said conductive mesh structure comprising niobium, titanium tungsten and aluminum;

providing a resistive layer on said insulating substrate and said conductive mesh structure;

forming an insulating layer over said resistive layer;

forming a conductive layer on said insulating layer;

forming a plurality of apertures through said conductive layer and through said insulating layer; and forming microtip emitters on said resistive layer within each of said apertures in said conductive layer.

2. The method in accordance with claim 1 wherein said conductive layer comprises titanium tungsten and aluminum.

3. The method in accordance with claim 1 wherein said conductive layer comprises niobium, titanium tungsten, and aluminum.

4. A method of fabricating an emitter plate for use in a field emission device, said method comprising steps of:

providing an insulating substrate;

depositing a first conductive layer on said substrate;

removing selected portions of said first conductive layer to form column conductors, column bond pads, integrated circuit mount pads, and first-level row and column interconnects;

depositing a resistive layer on said substrate overlaying said column conductors;

depositing an insulating layer over said resistive layer;

depositing a second conductive layer on said substrate;

removing selected portions of said second conductive layer to form row conductors, row bond pads and second-level row and column interconnects;

forming apertures in said second conductive layer and through said insulating layer; and forming cone-shaped microtips within said apertures on said resistive layer;

wherein at least one of said first and second conductive layers is formed as sublayers comprising a first metal which promotes adhesion and a second metal which promotes conductivity.

5. The method in accordance with claim 4 wherein at least one of said first and second conductive layers further comprises a niobium sublayer.

6. The method in accordance with claim 4 wherein said step of depositing a first conductive layer comprises the sub-steps of:

depositing a first sublayer of said adhesion-promoting metal;

depositing a second sublayer of said conductivity-promoting metal; and depositing a third sublayer of said adhesion-promoting metal.

7. The method in accordance with claim 6 further comprising the step of removing said third sublayer of the regions of said first conductive layer comprising said column bond pads, said integrated circuit mount pads, and said first-level row and column interconnects.

8. The apparatus in accordance with claim 6 wherein said first sublayer is selected from the group consisting of titanium tungsten, titanium, and titanium nitride; said second sublayer is selected from the group consisting of tungsten, aluminum, gold, silver and platinum; and said third sublayer is selected from the group consisting of titanium tungsten, tungsten, and titanium nitride.

9. The method in accordance with claim 4 wherein said step of depositing a second conductive layer comprises the sub-steps of:

depositing a first sublayer of said adhesion-promoting metal;

depositing a second sublayer of said conductivity-promoting metal; and depositing a third sublayer of said adhesion-promoting metal.

10. The method in accordance with claim 9 further comprising the step of removing said third sublayer of the regions of said second conductive layer comprising said row bond pads, and said second-level row and column interconnects.

11. The apparatus in accordance with claim 9 wherein said first sublayer is selected from the group consisting of titanium tungsten, titanium, and titanium nitride; said second sublayer is selected from the group consisting of tungsten, aluminum, gold, silver and platinum; and said third sublayer is selected from the group consisting of titanium tungsten, titanium, and titanium nitride.

12. The method in accordance with claim 4 wherein said first metal is selected from the group consisting of titanium tungsten, titanium, and titanium nitride.

13. The apparatus in accordance with claim 4 wherein said second metal is selected from the group consisting of tungsten, aluminum, gold, silver, and platinum.

* * * * *